US010483703B2

(12) United States Patent
Yamanaka

(10) Patent No.: US 10,483,703 B2
(45) Date of Patent: Nov. 19, 2019

(54) CONNECTOR

(71) Applicant: Molex, LLC, Lisle, IL (US)

(72) Inventor: Manabu Yamanaka, Lisle, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/324,131

(22) PCT Filed: Oct. 19, 2017

(86) PCT No.: PCT/US2017/057292
§ 371 (c)(1),
(2) Date: Feb. 8, 2019

(87) PCT Pub. No.: WO2018/080880
PCT Pub. Date: May 3, 2018

(65) Prior Publication Data

US 2019/0237921 A1 Aug. 1, 2019

(30) Foreign Application Priority Data

Oct. 24, 2016 (JP) ..... 2016-207833

(51) Int. Cl.
*H01R 24/00* (2011.01)
*H01R 24/86* (2011.01)
(Continued)

(52) U.S. Cl.
CPC ..... *H01R 24/86* (2013.01); *H01R 13/53* (2013.01); *H01R 13/6456* (2013.01); *H01R 2107/00* (2013.01)

(58) Field of Classification Search
CPC .... H01R 13/53; H01R 13/6456; H01R 24/86; H01R 2107/00
(Continued)

(56) References Cited

U.S. PATENT DOCUMENTS 7,422,463 B2 * 9/2008 Kuo ..... H01R 13/5205 439/277
9,419,374 B2 * 8/2016 Umbach ..... H01R 13/622
(Continued)

FOREIGN PATENT DOCUMENTS

| | | | |
|---|---|---|---|
| JP | S62-020146 | Y | 5/1987 |
| JP | 2011-249217 | A | 12/2011 |
| WO | 2018/080880 | A1 | 5/2018 |

OTHER PUBLICATIONS

International Search Report and Written Opinion received for PCT application No. PCT/US2017/057292, dated Jan. 19, 2018, 7 pages.

*Primary Examiner* — Khiem M Nguyen
(74) *Attorney, Agent, or Firm* — Molex, LLC

(57) ABSTRACT

A connector is provided which has a main body, a contact part, a tail part, and a plurality of terminals. The main body is made of an insulating material formed in a columnar shape extending in an inserting and extracting direction with a counterpart connector. The plurality of terminals are made of a conductive material loaded in the main body. The terminals are arranged around an axial wire extending in the inserting and extracting direction of the main body so that the position of the tail part forms a polygon in a plan view in a direction perpendicular to the axial wire. The main body includes a tail holding part extending in an axial wire direction. The tail part of each adjacent terminal is exposed at a different position in the axial wire direction in the tail holding part.

7 Claims, 7 Drawing Sheets

(51) Int. Cl.
*H01R 13/53* (2006.01)
*H01R 13/645* (2006.01)
*H01R 107/00* (2006.01)

(58) Field of Classification Search
USPC ..... 439/660, 675, 924
See application file for complete search history.

(56) References Cited

U.S. PATENT DOCUMENTS

| | | | |
|---|---|---|---|
| 2005/0250365 | A1 | 11/2005 | Starke et al. |
| 2008/0194137 | A1 | 8/2008 | Kuo |
| 2014/0256171 | A1 | 9/2014 | Liu |
| 2016/0134050 | A1 | 5/2016 | Umbach |

* cited by examiner

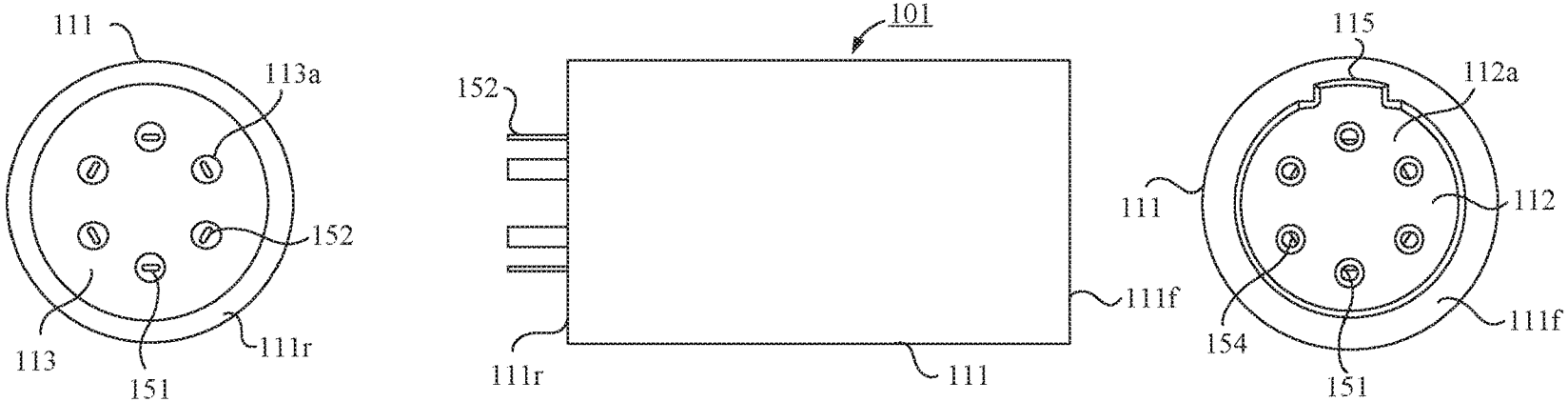
FIG. 4A
FIG. 4B
FIG. 4C
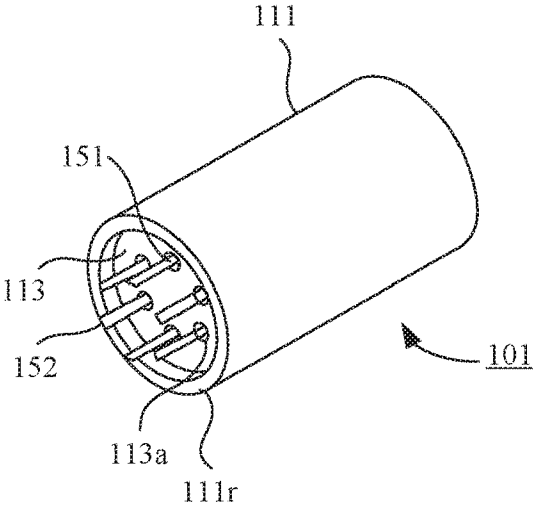
FIG. 4D
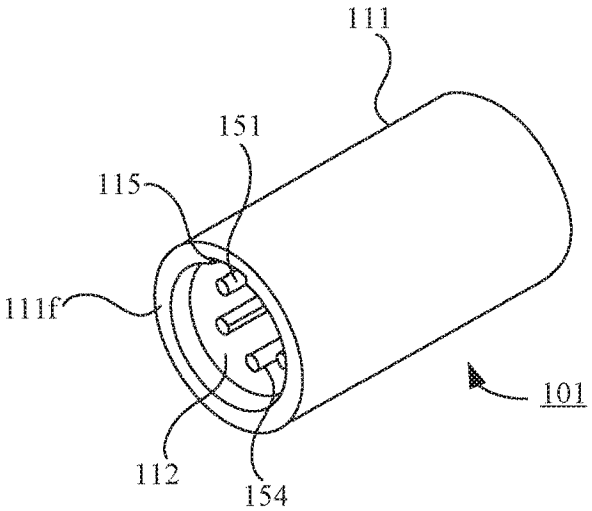
FIG. 4E

CONNECTOR

RELATED APPLICATIONS

This application claims priority to PCT application No. PCT/US2017/057292, filed on Oct. 19, 2017, which further claims priority to Japanese Application No. 2016-207833, filed Oct. 24, 2016, which is incorporated herein by reference in its entirety.

TECHNICAL FIELD

The present disclosure relates to a connector.

BACKGROUND ART

Connectors, such as wire to wire connectors, and the like, have been conventionally used to electrically connect cables provided with a plurality of core wires together. Such connectors are equipped with a plurality of terminals, where each core wire of a cable is connected to one end of each terminal through connecting means, such as soldering, or the like (for example, see Patent Document 1).

FIG. 7 is a perspective view illustrating a conventional connector.

In the figure, 811 is a cable connector housing formed from an insulating resin that fits a counterpart housing of a counterpart connector not illustrated in the figure. Furthermore, the housing 811 is provided with a plurality of terminals, and tail parts 852 of each of the terminals are exposed in the rear of the housing 811. End parts of core wires provided by a cable not illustrated in the figure are connected to the tail parts 852.

Because there are many terminals, namely twelve in the example illustrated in the figure, the terminals are arranged so as to form concentric circles, and the tail parts 852 are arranged so as to form a double circle. In this case, a holding member 821 made of an insulating resin is connected to the rear of the housing 811, and the tail parts 852 are held in a fitted state in grooves 826 formed in the surface of the holding member 821. Note that the holding member 821 has a two level shape that protrudes rearward, and a plurality of the grooves 826 are formed on the circumferential surface of each level so as to extend rearward. Therefore, because the tail parts 852 of the plurality of terminals are arranged in a state separated in two levels in an axial direction, soldering work to connect the end parts of the core wires to the tail parts 852 can be performed easily.

Patent Document 1: Japanese Examined Utility Model (Registration) Application No. S62-20146

SUMMARY

However, because the insulation distances between the tail parts 852 that are adjacent to one another are short in the conventional connector described above, there is a limit to how large the voltage between the terminals can be. That is, while the tail parts 852, which are adjacent to one another in a circumferential direction, are fitted into the grooves 826 of the holding member 821 and are thus insulated by the convex parts of the holding member 821, the creepage distance, which is the shortest distances along the surfaces of the convex parts, is not long. Furthermore, the creepage distance between the tail parts 852 adjacent to one another in an axial direction, is also not long.

Thus, an object here is to solve the problems of the conventional connector described above by providing a highly reliable connector where terminals are arranged around an axial wire of a connector main body, tail parts of adjacent terminals are exposed at different positions in an axial wire direction, and tail parts of diagonally positioned terminals are mutually exposed at the same position in the axial wire direction so that the creepage distance between adjacent terminals can be made longer even if the connector is miniaturized.

To this end, a connector, which is a connector provided with a plurality of terminals made of a conductive material loaded in a connector main body, has the connector main body made of an insulating material formed in a columnar shape extending in an inserting and extracting direction with respect to a counterpart connector, a contact part making contact with the counterpart connector and a counterpart terminal, and a tail part connected to a wire exposed from the connector main body on a side opposite the contact part, where the terminals are arranged around an axial wire extending in the inserting and extracting direction of the connector main body so that the positions of the tail parts form a polygon in a plan view in a direction perpendicular to the axial wire, the connector main body includes a tail holding part extending in an axial wire direction, and tail parts of adjacent terminals are exposed at different positions in the axial wire direction in the tail holding part.

Furthermore, in another connector, tail parts of terminals positioned diagonally in the tail holding part are exposed at the same position in the axial wire direction.

In yet another connector, the terminals are arranged so as to be positioned over a circumference centered on the axial wire of the connector main body.

In yet another connector, the tail parts of adjacent terminals are exposed at different positions in the axial wire direction in the tail holding part, and terminals, arranged in substantially symmetrical diagonal positions centered on the axial wire, are exposed at the same position in the axial wire direction.

In yet another connector, the tail holding part includes a plurality of groove parts formed in a surface thereof extending in an axial direction, and the tail parts of the terminals are exposed inside corresponding groove parts.

In yet another connector, the terminals are members that extend in the axial direction, parts other than the tail parts are buried in the connector main body, and the tail parts protrude rearward from front end surfaces of the groove parts.

In yet another connector, the groove parts extend to a rear end of the tail holding part from the front end surfaces, the positions of the front end surfaces are different sequentially in the axial direction, and diagonally positioned groove parts are such that the positions of the front end surfaces are the same sequentially in the axial direction.

According to the present disclosure, a connector has terminals arranged around an axial wire of a connector main body, tail parts of adjacent terminals are exposed at different positions in an axial wire direction, and tail parts of diagonally positioned terminals are exposed at the same position in the axial wire direction. Therefore, even if the connector is miniaturized, the creepage distance between adjacent terminals can be made long, thus improving reliability.

BRIEF DESCRIPTION OF THE DRAWINGS

FIG. 1A is a view as seen obliquely from the front, and FIG. 1B is a view as seen obliquely from the rear.

FIG. 2A is an elevation view, FIG. 2B is a side view, and FIG. 2C is a rear view.

FIG. 3A is a side view, FIG. 3B is a cross sectional view as seen along Arrow A-A in FIG. 3A, and FIG. 3C is a cross sectional view as seen along Arrow B-B in FIG. 3A.

FIGS. 4A-4E are five surface views of a second connector according to the present embodiment, where FIG. 4A is a rear view, FIG. 4B is a side view, FIG. 4C is an elevation view, FIG. 4D is a perspective view as seen obliquely from the rear, and FIG. 4E is a perspective view as seen obliquely from the front.

FIG. 5A is a side view, FIG. 5B is a perspective view as seen obliquely from the front, and FIG. 5C is a perspective view as seen obliquely from the rear.

FIG. 6A is a perspective view as seen from the second connector side, FIG. 6B is a perspective view as seen from the first connector side, and FIG. 6C is a side view where a wire connecting part of the first connector is covered with an outer circumferential covering member.

DETAILED DESCRIPTION OF THE PREFERRED EMBODIMENTS

Embodiments will be described in detail below with reference to the drawings.

Figures 1A, 1B:
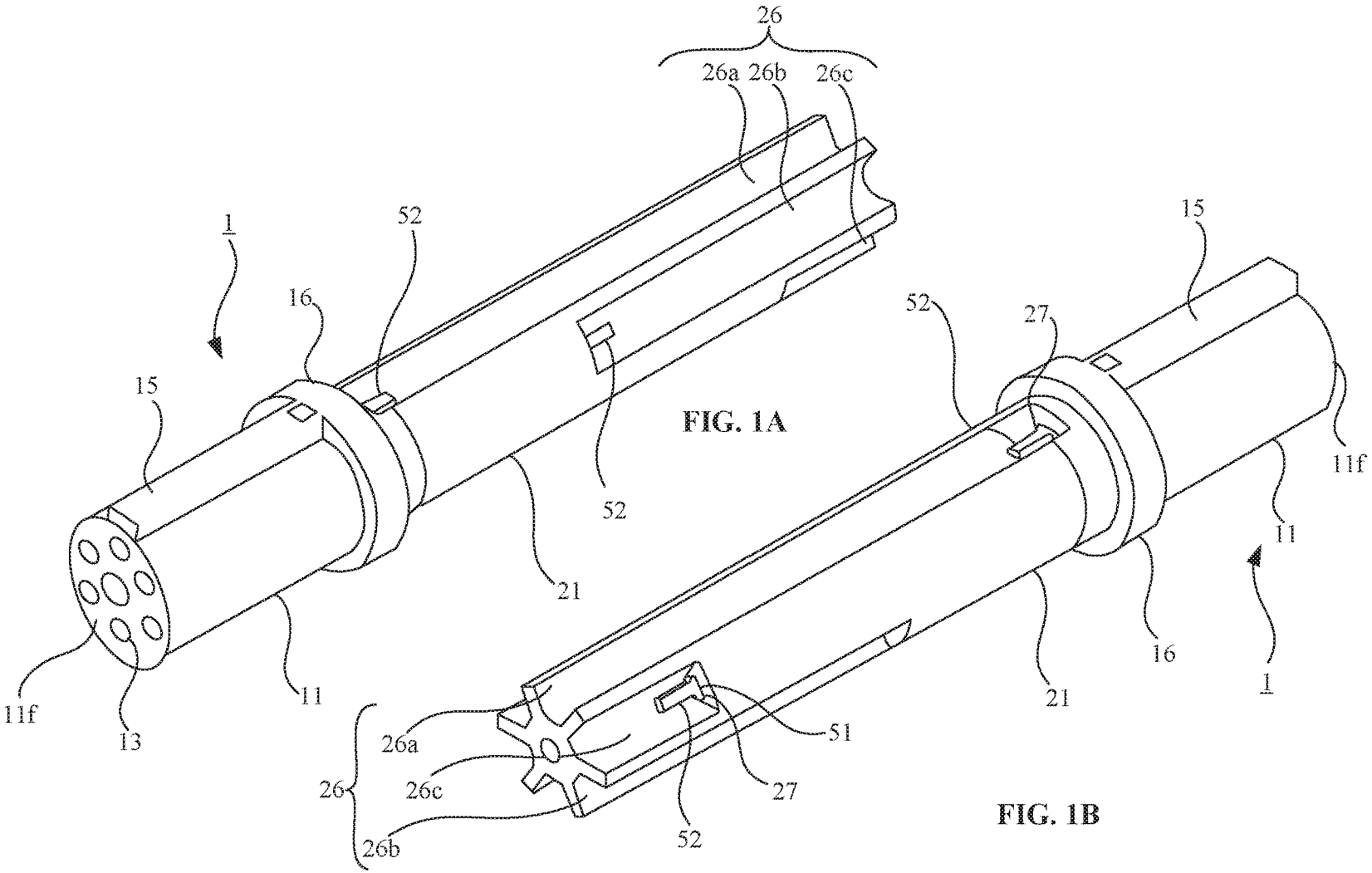
FIGS. 1A and 1B are perspective views of a first connector according to the present embodiment, where
Figure 2C:
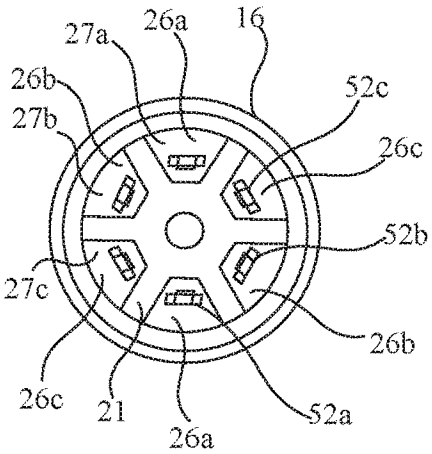
FIGS. 2A-2C are three surface views of the first connector according to the present embodiment, where
Figure 2B:
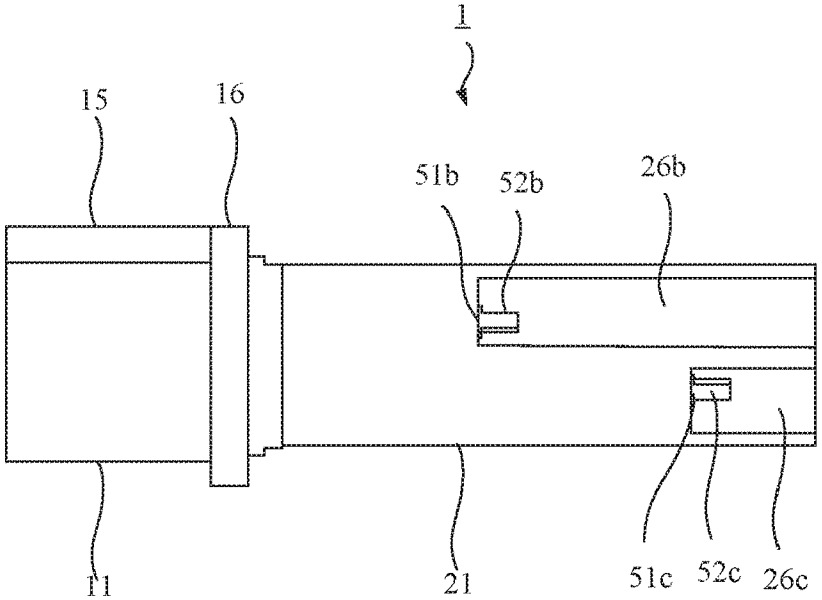
Figure 2A:
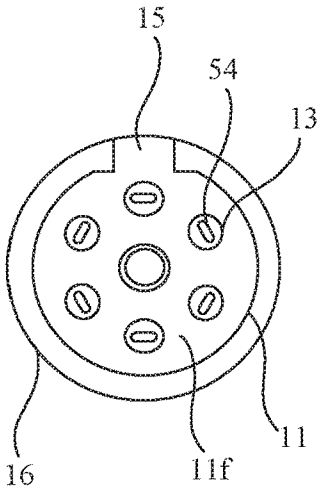
Figure 3A:
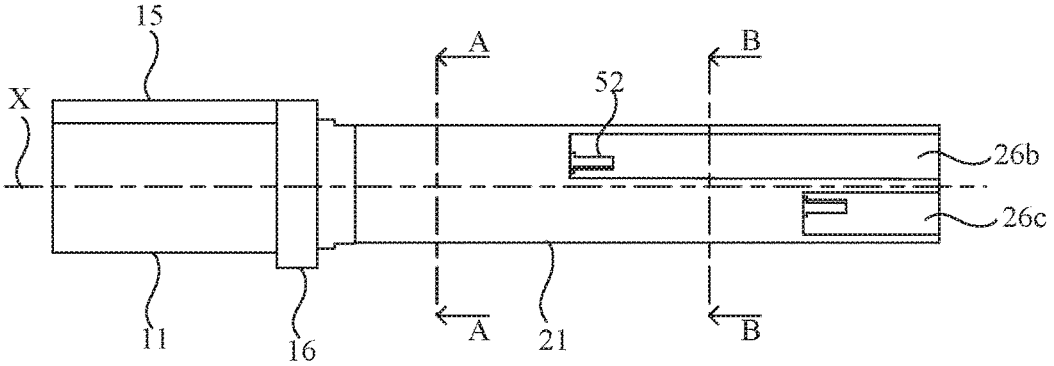
FIGS. 3A-3C are drawings for describing the structure of a wire stowing groove of the first connector according to the present embodiment, where
Figure 3B:
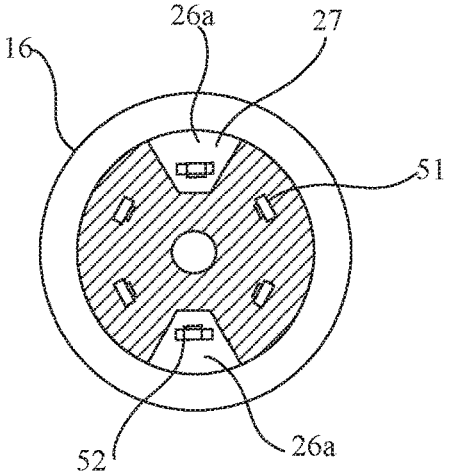
Figure 3C:
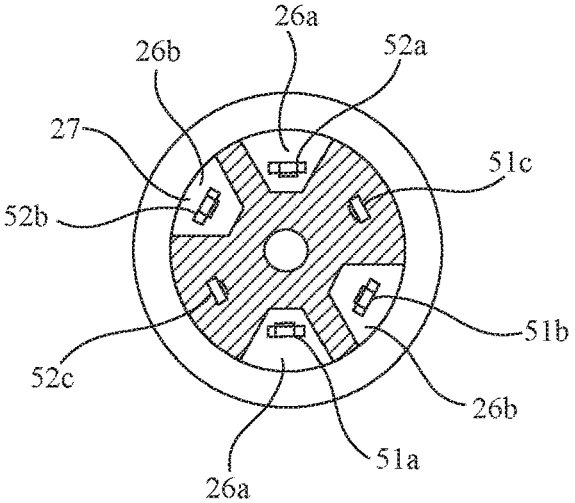

FIGS. 1A and 1B are perspective views of a first connector according to the present embodiment, FIGS. 2A-2C are three surface views of the first connector according to the present embodiment, and FIGS. 3A-3C are drawings for describing a wire stowing groove of the first connector according to the present embodiment. Note that, in FIG. 1A is a view as seen obliquely from the front, and FIG. 1B is a view as seen obliquely from the rear; in FIG. 2A is an elevation view, FIG. 2B is a side view, and FIG. 2C is a rear view; and, in FIG. 3A is a side view, FIG. 3B is a cross sectional view as seen along Arrow A-A in FIG. 3A, and FIG. 3C is a cross sectional view as seen along Arrow B-B in FIG. 3A.

In the figures, 1 is the connector according to the present embodiment, is a first connector of a pair of wire to wire connectors, is connected to a terminus of a cable provided with a plurality of wires 91, which will be described later, and fits with a counterpart second connector 101, which will also be described later. Furthermore, the second connector 101 is also connected to the terminus of a cable provided with a plurality of wires not illustrated in the figures.

The first connector 1 and the second connector 101 may be used in all kinds of equipment and devices, and the like, such as Industrial electrical equipment, home electrical appliances, air conditioning equipment, water heaters, medical equipment, and the like, but, for convenience of description, are connected here to a cable that can be used in environments where relatively high voltages (for example, several thousands of volts or more) are applied.

Furthermore, expressions for indicating directions such as up, down, left, right, front, back, and the like, used to describe the operations and configurations of the parts of the first connector and the second connector 101 in the present embodiment are not absolute but rather relative directions, and though appropriate when the parts of the first connector and the second connector 101 are in the postures illustrated in the figures, should be interpreted differently when these postures change, to correspond with said change.

The first connector 1 is integrally formed using an insulating body of a synthetic resin, and the like, and is provided with: a first housing 11 as a connector main body that fits with a below-described second housing 111 of the second connector 101; and a first terminal 51 as a terminal, which is a linear columnar member made of a conductive body of metal, or the like, buried in the first housing 11. The first terminal 51 is secured to the first housing 11 by, for example, at least part of the main body thereof being integrally fitted to the insulating member of the first housing 11.

The first housing 11 is a substantially cylindrical member that extends in an inserting and extracting direction (fitting direction) with respect to the second connector 101, that is, in a front to back direction, in other words, in an axial direction, of the first connector 1, where a front end of a terminal hole 13, in which a contact part 54 of the first terminal 51 is stowed, is open in an end surface of a fitting side, that is, in a front surface 11*f*. One of the contact parts 54 of the first terminal 51 is stowed in one of the terminal holes 13. Note that there may be any number of the terminal holes 13 and of the first terminals 51, and the number thereof may be optionally set, but, for convenience of description, that number is described here as being six, as illustrated in the figures.

As illustrated in the figures, because the terminal holes 13 are formed arranged around a center axis x as a virtual axial wire of the first housing 11, the first terminals 51 and the contact parts 54 are also arranged around the center axis x. More specifically, because the terminal holes 13 are arranged so as to be positioned above a circumference centered on the center axis x, the first terminals 51 and the contact parts 54 are also arranged so as to be positioned above a circumference centered on the center axis x, and, thereby form a hexagon as a polygon. Note that because the contact parts 54 are stowed inside the terminal holes 13 pulled back to the rear more than the front surface 11*f*, and front ends of the contact parts 54 are thus positioned further rearward than the front surface 11*f*, a position where a main body of the first terminals 51 inside the terminal holes 13 makes contact with the insulating member of the first housing 11 is significantly to the rear of the front surface 11*f*.

Furthermore, a polar protrusion 15 extending in the axial direction is integrally formed in one location on an outer circumference surface of the first housing 11. The polar protrusion 15 is a member the regulates the orientation of the first housing 11 with respect to the second housing 111 by fitting with a polar concave part 115, which will be described later, formed on the second housing 111.

Furthermore, the first housing 11 includes a flange part 16 formed on a back end thereof, and a wire connecting part 21 as a tail holding part integrally formed so as to protrude rearward from the flange part 16. The wire connecting part 21 is a substantially cylindrical member that extends in the axial direction, and a plurality of wire stowing grooves 26 are formed on an outer circumferential surface thereof as groove parts that extend in the axial direction. Just as with the terminal holes 13 and the first terminals 51, there may be any number of the wire stowing grooves 26, and the number thereof may be optionally set, but, for convenience of description, the number is described here as being six such that each wire stowing groove 26 corresponds to each terminal hole 13 and each first terminal 51.

As illustrated in the figures, the wire stowing grooves 26 are also arrayed around the center axis of the first housing 11. More specifically, the grooves are arrayed so as to be positioned over a circumference centered on the center axis x. Furthermore, all of the wire stowing grooves 26 extend to the rear end of the wire connecting part 21, that is, the rear ends thereof are open at the rear end of the wire connecting part 21, but the positions of front end surfaces 27 thereof differ sequentially in the axial direction. However, the positions of the front end surfaces 27 of the wire stowing grooves 26 positioned diagonally are the same. In other words, while the lengths of the wire stowing grooves 26 differ sequentially, the lengths of the wire stowing grooves 26 positioned diagonally are the same. Here, for convenience of description, the longest wire stowing groove 26 is described as a first stowing groove 26*a*, the next longest wire stowing groove 26 is described as a second stowing groove 26*b*, and the shortest wire stowing groove 26 is described as a third stowing groove 26*c*. Note that, when described collectively, the first stowing groove 26*a*, the second stowing groove 26*b*, and the third stowing groove 26*c* are described as the wire stowing grooves 26.

A longest first terminal 51*a* is arranged in a location corresponding to the first stowing groove 26*a*, a next longest first terminal 51*b* is arranged in a location corresponding to the second stowing groove 26*b*, and a shortest first terminal 51*c* is arranged in a location corresponding to the third stowing groove 26*c*. Note that, when described collectively, the longest first terminal 51*a*, the next longest first terminal 51*b*, and the shortest first terminal 51*c* are described as the first terminals 51.

The tail parts 52 of each of the first terminals 51 protrude rearward from the front end surfaces 27 of the wire stowing grooves 26, that is, from a surface near the flange part 16, and are exposed inside the wire stowing grooves 26.

Here, the front end surfaces 27 of the first stowing groove 26*a*, the second stowing groove 26*b*, and the third stowing groove 26*c*, and the tail parts 52 protruding therefrom, are described as a first front end surface 27*a* and a first tail part 52*a*, a second front end surface 27*b* and a second tail part 52*b*, and a third front end surface 27*c* and a third tail part 52*c*, respectively, and, when described collectively, are described as the front end surfaces 27 and the tail parts 52, respectively.

Note that parts other than the tail parts 52 of the first terminals 51 are buried in the first housing 11. As illustrated in the figures, the tail parts 52 are exposed at different positions sequentially in the axial direction, in the order of; the first tail part 52*a*, the second tail part 52*b*, and the third tail part 52*c*, inside corresponding wire stowing grooves 26. However, the tail parts 52 positioned diagonally, that is, the first tail part 52*a*, the second tail part 52*b*, and the third tail part 52*c* arranged at point symmetric positions across the center axis x, are exposed inside the wire stowing grooves 26 at the same position in the axial direction. Note that, whereas the first terminals 51 are linear columnar terminals extending in the axial direction, because the contact parts 54 stowed inside the terminal holes 13 are arranged so as to be positioned over a circumference centered on the center axis x of the first housing 11, the tail parts 52 are also arranged so as to be positioned over a circumference centered on the center axis x of the first housing 11, and are exposed inside the wire stowing grooves 26.

The configuration of the second connector 101, which is the other of the pair of wire to wire connectors, will be described next.

FIGS. 4A-4E are five surface views of the second connector according to the present embodiment. Note that, in the figure, FIG. 4A is a rear view, FIG. 4B is a side view, FIG. 4C is an elevation view, FIG. 4D is a perspective view as seen obliquely from the rear, and FIG. 4E is a perspective view as seen obliquely from the front.

The second connector 101 is provided with: the second housing 111 as a counterpart connector main body integrally formed using an insulating body of a synthetic resin, and the like, and a second terminal 151 as a counterpart terminal made from a conductive body of metal, or the like, buried in the second housing 111. The second terminal 151 is secured to the first housing 111 by, for example, at least part of the main body thereof being integrally fitted to the insulating member of the second housing 111.

The second housing 111 is a substantially cylindrical member that extends in an inserting and extracting direction with respect to the first connector 1, that is, in a front to back direction, in other words, in an axial direction, of the second connector 101, where a fitting concave part 112, into which a range from the front surface 11*f* of the first housing 11 to the flange part 16 fits, is formed in a front surface 111*f*. Furthermore, a polar concave part 115 that engages the polar protrusion 15 of the first housing 111 is formed in a wall that defines a circumference of the fitting concave part 112.

A contact part 154 of the second terminal 151 is arranged in the fitting concave part 112. The contact part 154 is cylindrical and extends forward from a bottom surface 112*a* of the fitting concave part 112. Note that the front end of the contact part 154 is positioned further rearward than the front surface 111*f*. Note that there may be any number of the contact parts 154 and of the second terminals 151 and that the number thereof may be optionally set, but, for convenience of explanation, that number is described here as being six, so as to be compatible with the first terminals 51. As illustrated in the figures, the contact parts 154 and terminal holes 113*a* are arranged so as to be positioned over a circumference centered on a center axis of the second housing 111. Furthermore, when the second housing 111 is fitted to the first housing 11, the contact parts 154 enter corresponding terminal holes 13, and the contact parts 54 of the first terminals 51 stowed inside the terminal holes 13 enter the cylindrical contact parts 154. Therefore, the second terminals 151 and the first terminals 51 are electrically connected.

Furthermore, a rear concave part 113 is formed in a rear surface 111*r* of the second housing 111, and the rear ends of the terminal holes 113*a* open into the rear concave part 113. Furthermore, the second terminals 151 are stowed inside the terminal holes 113*a*, and tail parts 152 of the second terminals 151 extend rearward from the openings of the terminal holes 113*a*. The rear ends of the tail parts 152 protrude further rearward than the rear surface 111*r*.

A description of an operation for fitting the first connector 1, having the aforementioned configuration, with the second connector 101 will be described next.

Figure 5A:
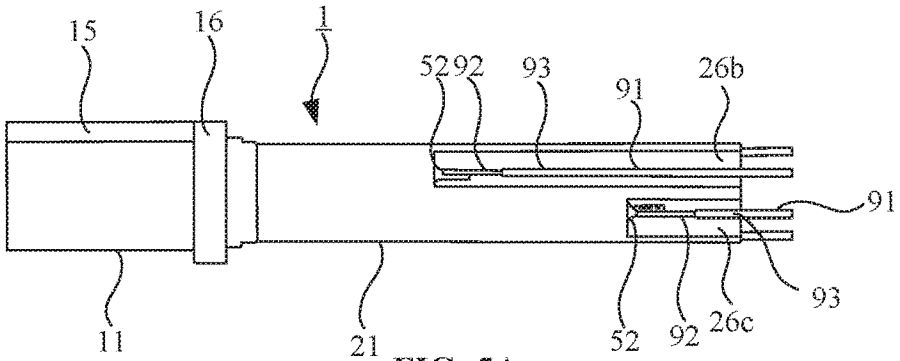
FIGS. 5A-5C are drawings of the first connector according to the present embodiment to which a wire is connected, where
Figure 5C:
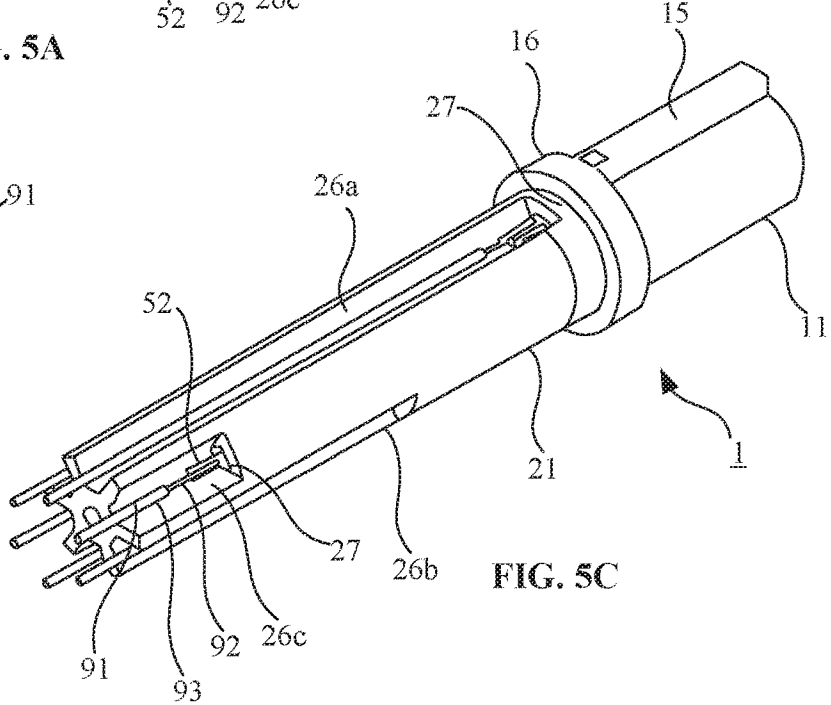
Figure 5B:
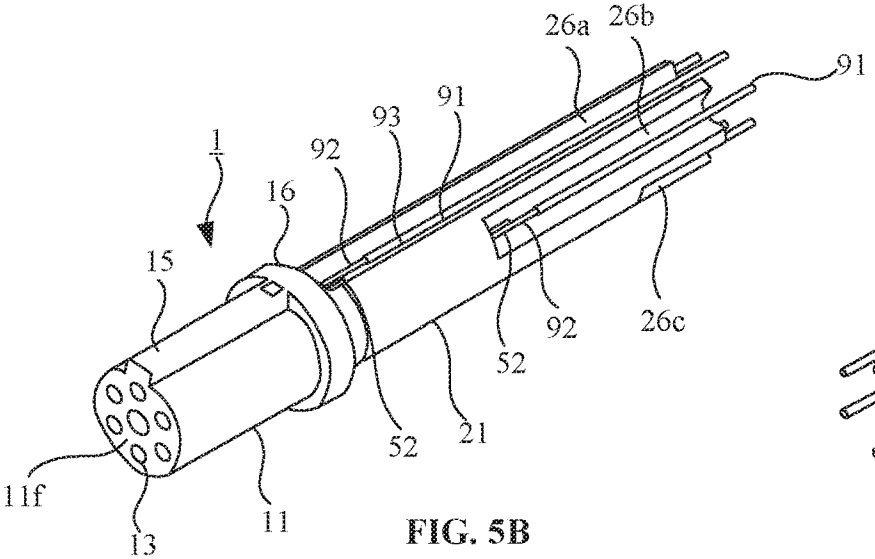
Figure 6B:
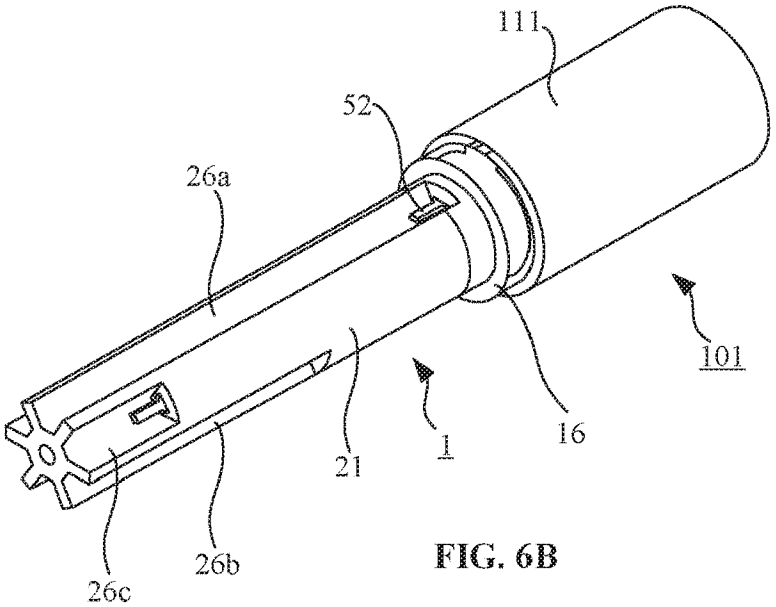
FIGS. 6A-6C are drawings illustrating the first connector and the second connector according to the present embodiment in a completely fitted state, where
Figure 6A:
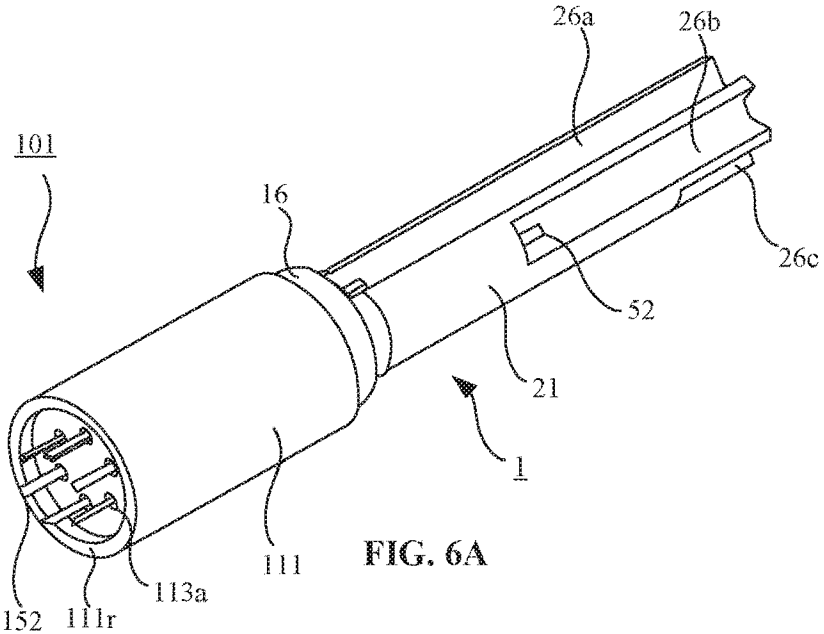
Figure 6C:
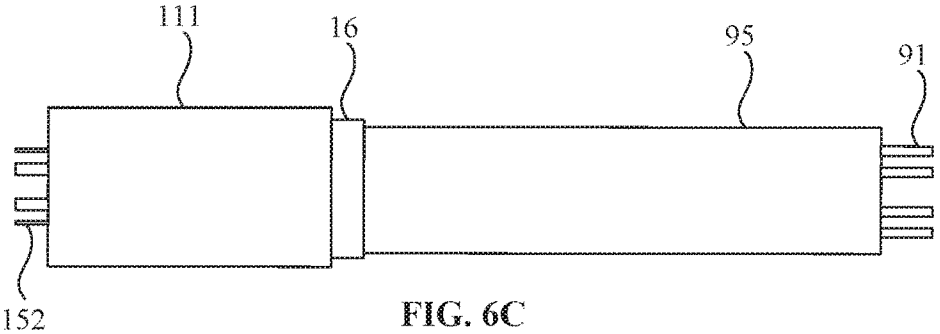
Figure 7:
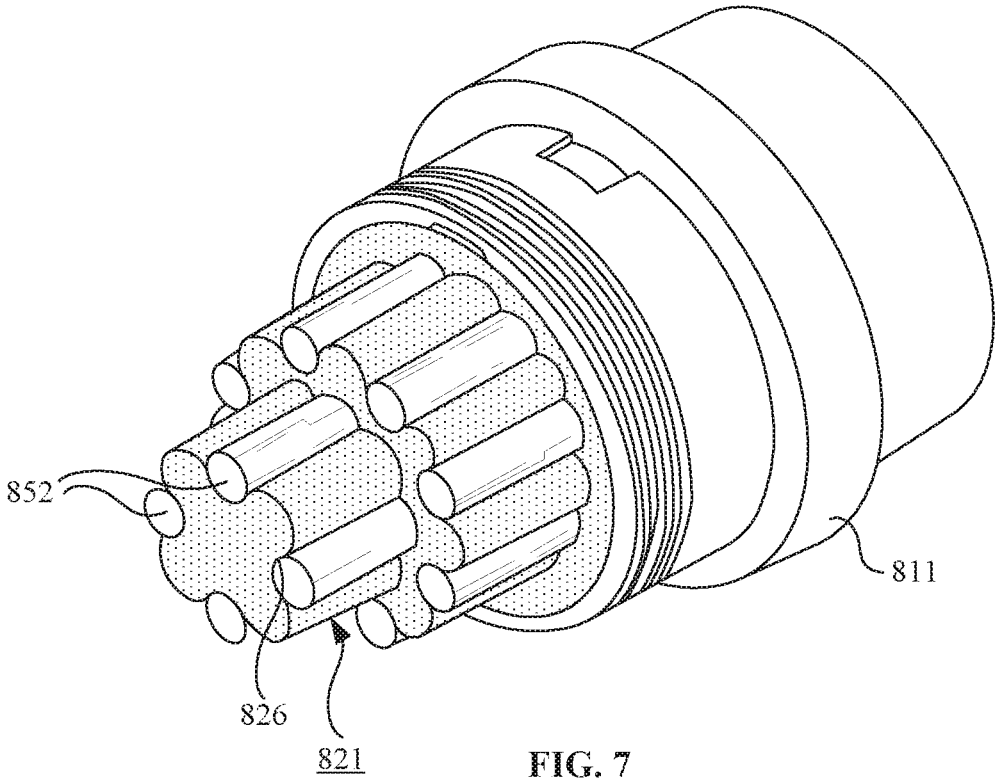
FIG. 7 Prior Art
FIG. 7 is a perspective view illustrating a conventional connector.

FIGS. 5A-5C are drawings of a first connector connected to a wire according to the present embodiment, and FIGS. 6A-6C are drawings illustrating the first connector and the second connector according to the present embodiment completely fitted together. Note that, in FIG. 5A is a side view, FIG. 5B is a perspective view as seen obliquely from the front, and FIG. 5C is a perspective view as seen obliquely from the rear; and in FIG. 6A is a perspective view as seen from the second connector side, FIG. 6B is perspective view as seen from the first connector side, and FIG. 6C is a side view where a wire connecting part of the first connector is covered with an outer covering member.

As illustrated in FIGS. 5A-5C, an insulating covering member 93 on end parts of a plurality (six in the example illustrated in the figure) of wires 91 was removed to expose a core wire 92. Note that it is preferable that the length of the exposed core wire 92 be longer than the tail parts 52 of the first terminals 51. Furthermore, the wires 91 are placed inside corresponding wire stowing grooves 26 parallel to the axial direction of the first connector 1. The core wires 92 of the wires 91 are connected to the tail parts 52 through connecting means, such as soldering, and the like, and are placed on the tail parts 52 of the first terminals 51 exposed on a front end inside the wire stowing grooves 26.

The core wires 92 of the wires 91 connected to the tail parts 52 of the first terminals 51, and to the tail parts 52 are not covered by an insulating material. Therefore, in order to achieve adequate electrical insulation between a tail part 52 and another tail part 52 or between the core wire 92 connected to the tail part 52 and the core wire 92 connected to another tail part 52, it is necessary to make the creepage distance between the tail part 52 and the other tail part 52, and, between the core wire 92 connected to the tail part 52 and the core wire 92 connected to another tail part 52 longer.

As has been described above, in the present embodiment, the tail parts 52 are sequentially exposed at different positions in the axial direction and are exposed inside corresponding wire stowing grooves 26, and the tail parts 52 positioned diagonally on opposite sides across the center axis x are exposed inside the wire stowing grooves 26 at the same position in the axial direction. Therefore, although the circumferential direction creepage distance along the surface of the wire connecting part 21 for the adjacent first tail part 52*a* and second tail part 52*b*, or the second tail part 52*b* and the third tail part 52*c*, is short, because there are spaces therebetween in the axial direction, the axial direction creepage distance along the surface of the wire connecting part 21 is long, and thus the total creepage distance is adequate. Furthermore, although there is zero axial direction creepage distance along the surface of the wire connecting part 21 for the first tail part 52*a*, second tail part 52*b*, and third tail part 52*c* positioned across the center axis x, the circumferential direction along the surface of the wire connecting part 21 is a fan shaped long arc with a center angle of 180 degrees, and is thus sufficiently long. Accordingly, in the present embodiment, an adequately long creepage distance can be maintained between the tail parts 52, even if the diameter of the wire connecting part 21 is small. Furthermore, the core wires 92 connected to the tail parts 52 likewise have adequate creepage distance. Therefore, because the creepage distances between the tail parts 52 and the core wires 92 are long enough, the occurrence of short circuit accidents is effectively prevented even if a high voltage is applied to the first terminals 51 and the core wires 92.

If the radius of the circumference on which the first terminals 51 are placed is increased, it is also possible to place every other first terminal 51 diagonally. In this case, the circumferential distance creepage distance is a fan shaped long arc with a center angle of 120 degrees. In the present embodiment, the diagonally positioned tail parts 52 are placed on opposite sides across the center axis x, that is, in positions having a fan shaped long arc with a center angle of 180 degrees, and, when so arranged, can be arranged closest to the center axis x when the same number of terminals are used.

It is best to arrange the terminals so as to be at symmetrical positions in the same axial direction positions when an even number of terminals are used, and so as to be in substantially point symmetrical positions when an odd number of terminals are used.

Note that as illustrated in FIG. 6C, to protect the wires 91, and the like stowed inside the wire stowing grooves 26, the entire wire connecting part 21 where the wires 91 are stowed inside the wire stowing grooves 26 may be covered with an outer circumferential covering member 95. Because the outer circumferential covering material 95 does not necessarily come into close contact with the surfaces of the tail parts 52 and the core wires 92 in this case either, the inside of the outer circumferential covering material 95 is, as is illustrated in FIGS. 5A-5C, probably in the same state as when the tail parts 52 and the core wires 92 are exposed inside the wire stowing grooves 26, however, as was described above, the occurrence of short circuit accidents is effectively prevented because the creepage distance is sufficiently long.

Furthermore, as was described above, the contact parts 54 of the first terminals 51 are stowed inside the terminal holes 13 pulled back to the rear more than the front surface 11*f*, furthermore, a position where the main body of the first terminals 51 inside the terminal holes 13 makes contact with the insulating member of the first housing 11 is significantly to the rear of the front surface 11*f*. Therefore, because the creepage distance for the contact parts 54 and the first terminals 51 stowed inside the terminal holes 13 is sufficiently long, short circuit accidents can be effectively prevented.

When fitting the first connector 1 and the second connector 101 together, an operator first sets the front surface 11*f*, which is the fitting surface of the first housing 11 of the first connector 1, and the front surface 111*f*, which is the fitting surface of the second housing 111 of the second connector 101 facing one another, then, the operator aligns the position of the polar protrusion 15 of the first housing 11 with the position of the polar concave part 115 of the second housing 111. This completes the alignment of the first connector 1 and the second connector 101.

In this state, when the operator moves the first connector 1 and/or the second connector 101 toward the other, that is, in a fitting direction, the polar protrusion 15 and the polar concave part 115 lock together, and the range from the front surface 11*f* of the first housing 11 to the flange part 16 is fitted in the fitting concave part 112 of the second housing 111. Furthermore, the cylindrical contact parts 154 of the second terminals 151 enter the terminal holes 13 of the first housing 11, the contact parts 54 of the first terminals 51 that are stored in the terminal holes 13 enter the contact parts 154 of the second terminals 151, and thus the first terminals 51 and the second terminals 151 are electrically connected. As illustrated in FIGS. 6A-6C, this completes the fitting of the first connector 1 with the second connector 101.

Therefore, in the present embodiment, the first connector 1 is provided with: the first housing 11 made from an insulating material formed in a columnar shape extending in an inserting and extracting direction with respect to the second connector 101; the contact parts 54 that make contact with the second terminals 151 of the second connector 101; and the tail parts 52 connected to the wires 91 exposed from the first housing 11 on the side opposite the contact parts 54; and is provided with a plurality of the first terminals 51 made from a conductive material buried in the first housing 11. Furthermore, the first terminals 51 are arranged such that the positions of the tail parts 52 are polygonal in a plan view in a direction perpendicular to the center axis x around the center axis x extending in the inserting and extracting direction of the first housing 11; the first housing 11 includes the wire connecting part 21 that extends in the axial direction; and, in the wire connecting part 21, the tail parts 52 of adjacent first terminals 51 are exposed at different positions in the center axis x direction, and the diagonally positioned tail parts 52 of the first terminals 51 are exposed at the same position in the center axis x direction.

Therefore, because the creepage distance of the tail parts 52 of the exposed first terminals 51 is sufficiently long even if the connector 1 is miniaturized and the diameter of the wire connecting part 21 is small, short circuit accidents will not occur even if high voltage is applied to the first terminals 51.

Furthermore, in the wire connecting part 21, the tail parts 52 of the adjacent first terminals 51 are exposed at different positions sequentially in the axial direction, and, the diagonally positioned first terminals 51 are the first terminals 51 arranged so as to be substantially point symmetrically positioned centered on the center axis x. Additionally, the first terminals 51 are arrayed so as to be positioned above a circumference centered on the center axis x of the first housing 11. Moreover, the wire connecting part 21 includes a plurality of the wire stowing grooves 26 formed in a surface thereof extending in the axial direction, and the tail parts 52 of the first terminals 51 are exposed in corresponding wire stowing grooves 26. Accordingly, the creepage distance of the tail parts 52 becomes even longer, making it possible to even more effectively prevent short circuit accidents.

Furthermore, the first terminals 51 are members that extend in the axial direction where parts other than the tail parts 52 are buried in the first housing 11, and the tail parts 52 protrude rearward from the front end surfaces 27 of the wire stowing grooves 26. Finally, the wire stowing grooves 26 extend from the front end surfaces 27 to the rear end of the wire connecting part 21 such that the positions of the front end surfaces 27 differ sequentially in the axial direction, and the diagonally positioned wire stowing grooves 26 are such that the positions of the front end surfaces 27 are the same sequentially in the axial direction. Therefore, because parts other than the tail parts 52 of the first terminals 51 are buried in the first housing 11 and exposed inside the wire stowing grooves 26, the occurrence of short circuit accidents can be effectively prevented.

Note that the disclosure of the present specification describes characteristics related to preferred and exemplary embodiments. Various other embodiments, modifications and variations within the scope and spirit of the claims appended hereto could naturally be conceived of by persons skilled in the art by summarizing the disclosures of the present specification.

The present disclosure can be applied to connectors.

The invention claimed is:

1. A connector comprising:

a connector main body made from an insulating material formed in a columnar shape extending in an inserting and extracting direction with respect to a counterpart connector;

a contact part that makes contact with a counterpart terminal of the counterpart connector; and a plurality of terminals made of a conductive material having tail parts connected to wires exposed from the connector main body on the side opposite the contact part, wherein the terminals are arrayed such that the positions of the tail parts are polygonal in a plan view in a direction perpendicular to the wires around a wire extending in an inserting and extracting direction of the connector main body, wherein the connector main body includes a tail holding part extending in the axial direction, and wherein the tail parts of adjacent terminals are exposed in the tail holding part at a different positions in the axial direction.

2. The connector according to claim 1, wherein the tail parts of diagonally positioned terminals are exposed in the tail holding part at the same position in the axial direction.

3. The connector according to claim 1, wherein the terminals are arrayed so as to be positioned over a circumference centered on an axial wire of the connector main body.

4. The connector according to claim 3, wherein the tail parts of the adjacent terminals are exposed at different positions in the axial wire direction in the tail holding part, and the terminals, arranged in substantially symmetrical diagonal positions centered on the axial wire, are exposed at the same position in the axial wire direction.

5. The connector according to claim 1, wherein the tail holding part includes a plurality of groove parts extending in an axial direction formed in a front surface thereof, and the tail parts of the terminals are exposed inside corresponding groove parts.

6. The connector according to claim 5, wherein the terminals are members that extend in an axial direction, parts other than the tail parts are buried in the connector main body, and the tail parts protrude rearward from front end surfaces of the groove parts.

7. The connector according to claim 6, wherein the groove parts extend to a rear end of the tail holding part from the front end surfaces, the positions of the front end surfaces are different sequentially in the axial direction, and diagonally positioned groove parts are such that the positions of the front end surfaces are the same sequentially in the axial direction.

* * * * *